US005285049A

United States Patent [19]

Fukumoto et al.

[11] Patent Number: 5,285,049

[45] Date of Patent: Feb. 8, 1994

[54] HEATER FOR SHEET MATERIAL

[75] Inventors: Hiroshi Fukumoto; Shigeo Ota; Fumiaki Tagashira; Shingo Ooyama, all of Kyoto, Japan

[73] Assignee: Rohm Co., Ltd., Kyoto, Japan

[21] Appl. No.: 904,044

[22] Filed: Jun. 18, 1992

[30] Foreign Application Priority Data

Jul. 25, 1991 [JP] Japan ..... 3-186351

[51] Int. Cl.[5] ..... H05B 3/16; H01C 1/012; H01C 1/14

[52] U.S. Cl. ..... 219/216; 219/543; 338/307; 338/325; 338/333

[58] Field of Search ..... 219/216, 543, 522, 469, 219/548, 541; 346/76 PH; 338/307, 305, 309, 306-314, 322, 325, 333; 355/285

[56] References Cited

U.S. PATENT DOCUMENTS

| | | | |
|---|---|---|---|
| 2,288,232 | 6/1942 | Driscoll | 219/549 |
| 2,758,256 | 8/1956 | Eisler | 338/308 |
| 3,287,684 | 11/1966 | Armbruster | 219/541 |
| 3,621,441 | 11/1971 | Hudnall | 338/309 |
| 4,354,092 | 10/1982 | Manabe | 219/225 |
| 5,068,517 | 11/1991 | Tsuyuki et al. | 219/543 |

FOREIGN PATENT DOCUMENTS

| | | | |
|---|---|---|---|
| 0070592 | 4/1984 | Japan | 346/76 PH |
| 0217174 | 10/1985 | Japan | 346/76 PH |
| 0027267 | 2/1986 | Japan | 346/76 PH |

*Primary Examiner*—Bruce A. Reynolds
*Assistant Examiner*—Michael D. Switzer
*Attorney, Agent, or Firm*—William H. Eilberg

[57] ABSTRACT

A heater comprises an insulating substrate which carries a pair of transversely conductor strips, a resistor line extending between the respective conductor strips. The respective conductor strips are connected to the resistor line by electrode teeth spaced longitudinally of the main resistor line and arranged in staggered relation on both sides of the resistor line.

4 Claims, 8 Drawing Sheets

HEATER FOR SHEET MATERIAL

BACKGROUND OF THE INVENTION

1. Field of the Invention

This invention relates generally to heaters. More specifically, the present invention relates to a linear heater which can be advantageously used in an office automation apparatus such as a photocopier or electrographic printer for fixing images on a paper sheet for example.

2. Description of the Prior Art

Various types of linear heaters are known for fixing images (deposited toner) on a paper sheet in photocopiers or electrographic printers (e.g. laser beam printer). Typical examples include a lamp heater and a roller heater.

However, the lamp heater and roller heater are equally disadvantageous in that there is a limitation in reducing size (thickness) and cost. Further, the lamp heater is easily damaged due to the nature of material, whereas the roller heater has a complicated structure due to the necessity of incorporating plural heating elements within the roller.

To eliminate the problems of the conventional heaters, U.S. Pat. No. 5,068,517 to Tsuyuki et al (Patented: Nov. 26, 1991; Filed: Aug. 22, 1989) proposes a strip heater which comprises an elongate insulating substrate having a surface provided with a printed resistor strip. Both ends of the resistor strip are enlarged and coated with silver for connection to a power source. The resistor strip, which is made of e.g. silver-palladium alloy, generates heat when a current is passed therethrough. The resistor strip is covered by a glass layer to provide smooth contact with a paper sheet.

Obviously, the strip heater of the above U.S. patent is very simple in arrangement. Further, the strip heater can be made very thin by reducing the thickness of the substrate. However, the strip heater is still disadvantageous in the following points.

First, since the resistor strip is continuous, it becomes inoperative even if it is broken or disconnected only at one portion thereof. Thus, in such an event, the strip heater as a whole must be replaced.

Secondly, the enlarged ends of the resistor strip, which are coated with silver, are the portions where heat dissipation occurs most easily. Thus, if the resistor strip is made to have a constant width over the entire length thereof, an uneven temperature distribution will result in which the surface temperature of the resistor strip is lower near the enlarged ends than at the center. This problem itself can be solved if the width of the resistor strip is made to reduce progressively toward the enlarged ends, as taught in the above U.S. patent. However, such a solution gives rise to a new problem that the narrower end portions of the resistor strip are more easily broken because, in spite of the reduced width, the narrower end portions generate a greater amount of heat than the central portion.

SUMMARY OF THE INVENTION

It is, therefore, an object of the present invention to provide a linear heater which is capable of operating for heat generation even if the heater is partially broken.

Another object of the present invention is to provide a linear heater which is capable of providing a longitudinally equalized temperature distribution without increasing the likelihood of breakage.

A further object of the present invention is to provide a linear heater which is capable of providing a transversely equalized temperature distribution.

A still another object of the present invention is to provide an improved heating unit for an apparatus, particularly a photocopier or electrographic printer, which requires a heating operation for image fixation for example.

According to one aspect of the present invention, there is provided a heater comprising an insulating substrate which carries a first conductor strip and a second conductor strip spaced transversely from the first conductor strip, the substrate further carrying at least one main resistor line extending between the first and second conductor strips, the first conductor strip having a plurality of electrode teeth spaced longitudinally of the main resistor line and electrically connected thereto, the second conductor strip also having a plurality of electrode teeth spaced longitudinally of the main resistor line and electrically connected thereto in staggered relation to the electrode teeth of the first conductor strip.

With the arrangement described above, the resistor line is divided into a plurality of heating dots which generate heat independently of each other. Thus, the heater is still operative for heat generation even if the resistor line is partially broken. Further, the temperature distribution of the heater can be equalized simply by arranging the electrode teeth more densely near the ends of the heater than near the center or by making the resistor line wider near the ends of the heat than at the center. Moreover, the temperature distribution can be equalized transversely simply by arranging two or more resistor lines. Other arrangements may be adopted for equalizing the temperature distribution longitudinally and/or transversely of the heater.

According to another aspect of the present invention, there is provided a heating unit for an apparatus requiring a heating operation relative to a sheet material, the heating unit comprising an insulating substrate which carries a first conductor strip and a second conductor strip spaced transversely from the first conductor strip, the substrate further carrying at least one main resistor line extending between the first and second conductor strips, the first conductor strips having a plurality of electrode teeth spaced longitudinally of the main resistor line and electrically connected thereto, the second conductor strip also having a plurality of electrode teeth spaced longitudinally of the main resistor line and electrically connected thereto in staggered relation to the electrode teeth of the first conductor strip.

Other objects, features and advantages of the present invention will become apparent from the following detailed description of the preferred embodiments given with reference to the accompanying drawings.

DETAILED DESCRIPTION OF THE PREFERRED EMBODIMENTS

Figure 1:
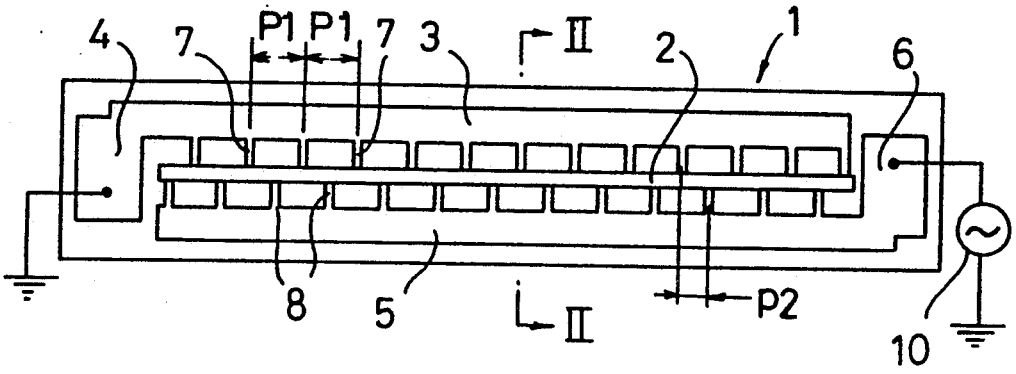
FIG. 1 is a plan view showing a heater according to a first embodiment of the present invention.
Figure 2:
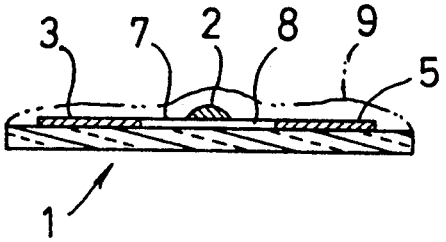
FIG. 2 is a sectional view taken along lines II—II in FIG. 1.
Figure 3:
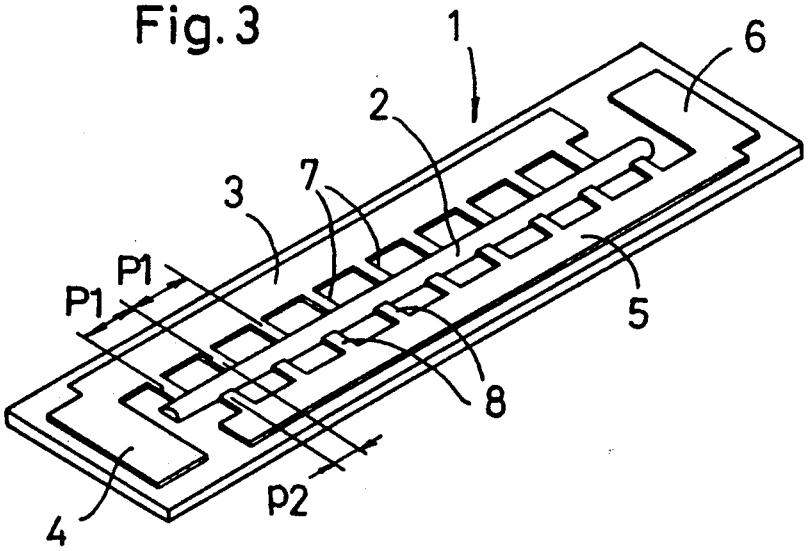
FIG. 3 is a perspective view showing the same heater.

Referring now to FIGS. 1-3 showing a heater according to a first embodiment of the present invention, there is illustrated an elongate substrate 1 made of a heat-resistant insulating material such as ceramic. The substrate has an upper surface formed with a heating resistor line 2 of a suitable width extending longitudinally of the substrate. Further, the upper surface of the substrate carries a first printed conductor strip 3 having an enlarged connection terminal 4, and a second printed conductor strip 5 similarly having an enlarged connection terminal 6. The respective conductor strips 3, 5 also extend longitudinally of the substrate in parallel to each other on both sides of the resistor line 2. The respective connection terminals 4, 6 are located near the opposite ends of the substrate 1 and connected to an alternating power source 10.

According to the first embodiment, the first conductor strip 3 has comb-like electrode teeth 7 arranged at a constant pitch P1 longitudinally of the substrate for connection to the resistor line 2. Similarly, the second conductor strip 5 has comb-like electrode teeth 8 arranged at a constant pitch P1 longitudinally of the substrate for connection to the resistor line 2 in staggered relation to the comb-like electrode teeth 7 of the first conductor strip 3. Further, a protective layer 9 is formed on the substrate 1 to cover the respective conductor strips 3, 5 together with the resistor line 2, as shown in FIG. 2.

The first and second conductor strips 3, 5 together with the respective connection terminals 4, 6 and electrode teeth 7, 8 may be formed by depositing a layer of e.g. gold or silver paste on the substrate surface, thereafter baking the deposited paste layer, and finally etching the layer by means of photolithography. The formation of the heating resistor line 2 may be performed, after the above-mentioned etching, by depositing a line of pasty resistor material such ruthenium oxide or silver-palladium alloy, and thereafter baking the deposited resistor material. The protective layer 9 may be made of glass for example to have a smooth surface for contact with paper.

With the arrangement described above, the heating resistor line 2 is electrically divided by the respective electrode teeth 7, 8 into a plurality of heating dots each having a length P2 which is half P1. Thus, the respective heating dots ar electrically independent from each other but capable of generating heat simultaneously along the entire resistor line 2.

Obviously, due to the division into the heating dots, even if one or more portions of the resistor line 2 is broken, only the broken heating dots become inoperative but the remaining heating dots are still operative for heat generation. Thus, there is no need to replace the heater as a whole.

Figure 4:
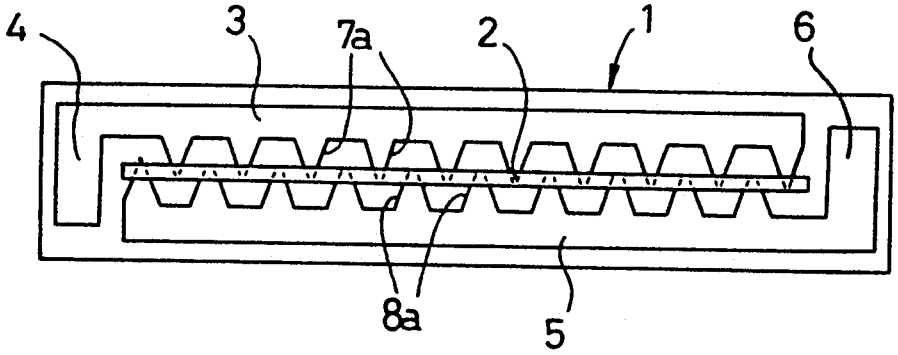
FIG. 4 is a plan view showing a heater according to a second embodiment of the present invention.

FIG. 4 shows a heater according to a second embodiment of the present invention. The heater of this embodiment differs from that of the first embodiment only in that the first and second conductor strips 3, 5 respectively have saw-like electrode teeth 7*a*, 8*a*.

The comb-like electrode teeth 7, 8 shown in FIGS. 1 and 3 are relatively slender, so that the photolithography method is required to enable minute patterning. However, the saw-like electrode teeth 7*a*, 8*a* together with the respective conductor strips 3, 5 may be formed by the mask printing method, thereby reducing the manufacturing cost for the heater.

In either of the foregoing embodiments, the heating resistor line 2 and the conductor strips 3, 5 with the respective electrode teeth 7, 8 (or 7*a*, 8*a*) may be formed indirectly on the surface of the substrate 1 via an intervening glaze layer (not shown). However, it is preferable that these printed elements be formed directly on the substrate surface, as shown in FIG. 2. The reason for this is described with reference to FIGS. 5 and 6.

Figure 5:
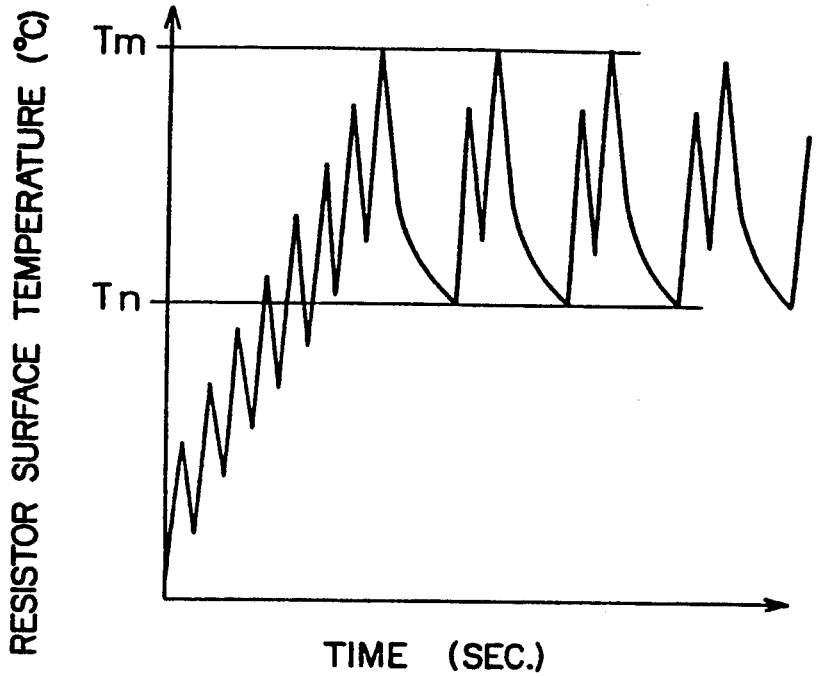
FIG. 5 is a graph showing the heating characteristic of the heater of FIG. 1 or 4 when incorporating an intervening glaze layer.

FIG. 5 shows the heating characteristic obtainable when the resistor line is formed indirectly on a substrate surface via an intervening glaze layer. At the initial stage of operation, the surface temperature of the resistor line continues to rise until a steady operating state is reached. In the steady state, the surface temperature fluctuates between a maximum operating temperature Tm and a minimum operating temperature Tn due to the alternating nature of the power source. The difference between Tm and Tn has been experimentally confirmed to be about 200° C., and this large difference is considered attributable mainly to the heat retaining nature of the glaze layer.

Figure 6:
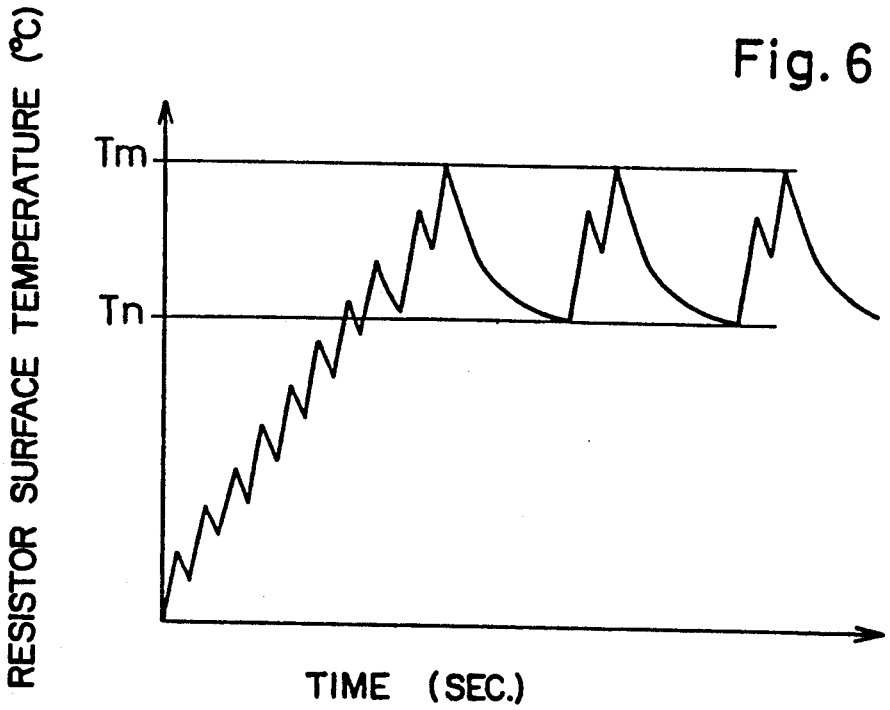
FIG. 6 is graph showing the heating characteristic of the same heater without an intervening glaze layer.

FIG. 6 shows the heating characteristic obtainable when the resistor line 2 is formed directly on the substrate surface, as shown in FIG. 2. In this case, again, the surface temperature of the resistor line 2 fluctuates between a maximum operating temperature Tm and a minimum operating temperature Tn in the steady operating state, but the difference between Tm and Tn reduces to about 100° C.

Comparison between FIGS. 5 and 6 clearly suggests that the heating resistor line 2 should be formed directly on the substrate surface in order to minimize the temperature fluctuation which would inevitably result from the use of the AC power source 10. However, for applications which allow a large temperature fluctuation, the substrate surface may be formed with an intervening glaze layer.

Figure 7:
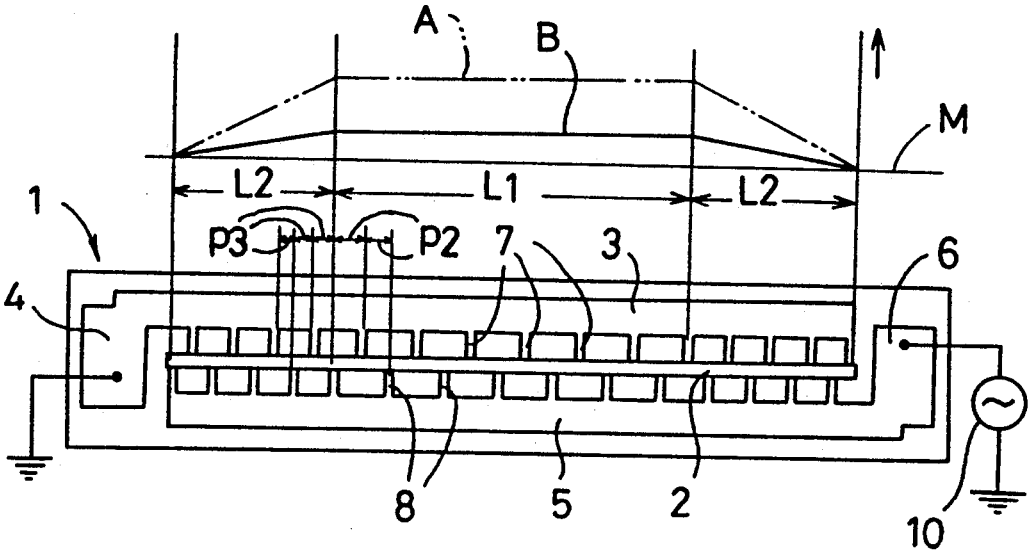
FIG. 7 is a plan view showing a heater according to a third embodiment of the present invention.

FIG. 7 shows a heater according to a third embodiment of the present invention. The heater of the third embodiment differs from that of the first embodiment (FIGS. 1-3) only in that those of the heating dots located adjacent to the respective connection terminals 4, 6 (in end regions L2) are made to have a smaller length P3 than the remaining heating dots (length P2) located in a central region L1.

Since the enlarged connection terminals 4, 6 of the respective conductor strips 3, 5 act to dissipate heat very easily, those of the heating dots located adjacent to the connection terminals 4, 6 lose the generated heat more easily than the remaining dots. As a result, if all of the heating dots are made to have a constant dot length P2 to individually generate an equal amount of heat, a temperature distribution will result wherein the temperature is sharply higher at the central portion L1 of the heater than at the end portions L2 thereof, as indicated by a chain line A in FIG. 7. Thus, if the end portion temperature of the heater is adjusted to become higher than a required minimum operation temperature (indicated by a horizontal line M in FIG. 7), the central portion temperature must be rendered unnecessarily high.

According to the third embodiment, on the other hand, all of the heating dots in the resistor line 2 are subjected to an equal voltage, but those of the heating dots located in the end portions L2 of the resistor line 2 have a smaller dot length P3 (i.e., smaller resistivity) than the remaining heating dots in the central portion L1. As a result, heat generation is higher in the end portions L2 than in the central portion L1, thereby compensating for the increased heat dissipation at the connection terminals 4, 6. Thus, the heater will have a temperature distribution which is more equalized longitudinally of the heater, as indicated by a solid line B in FIG. 7.

Figure 8:
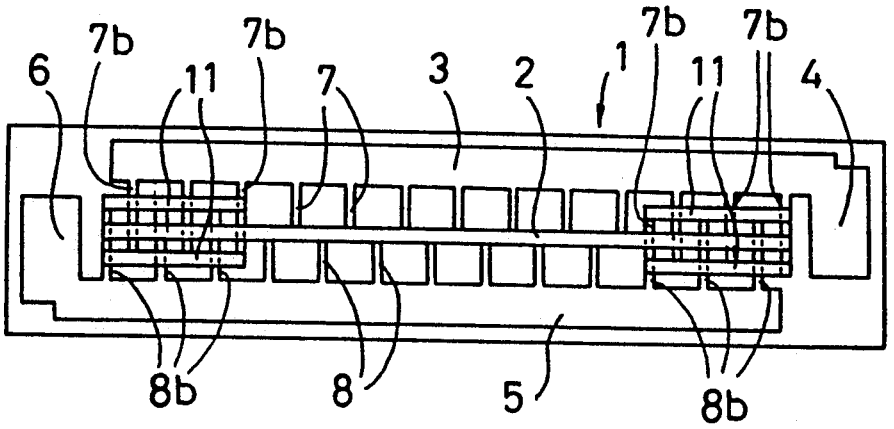
FIG. 8 is a plan view showing a heater according to a fourth embodiment of the present invention.

FIG. 8 shows a heater according to a fourth embodiment of the present invention. In this embodiment, the first conductor strip 3 has central electrode teeth 7 and end electrode teeth 7*b*. Similarly, the second conductor strip 5 has central electrode teeth 8 and end electrode teeth 8*b*. The respective end electrode teeth 7*b*, 8*b* extend transversely beyond the heating resistor line 2 toward the counterpart conductor strips.

The heater of the fourth embodiment further includes auxiliary resistor lines 11 located on both sides of the main resistor line 2 for connecting between the respective end electrode teeth 7*b*, 8*b*. These auxiliary resistor lines provide additional heat generation to compensate for higher heat dissipation at the respective connection terminals 4, 6, thereby equalizing the temperature distribution longitudinally of the heater.

Figure 9:
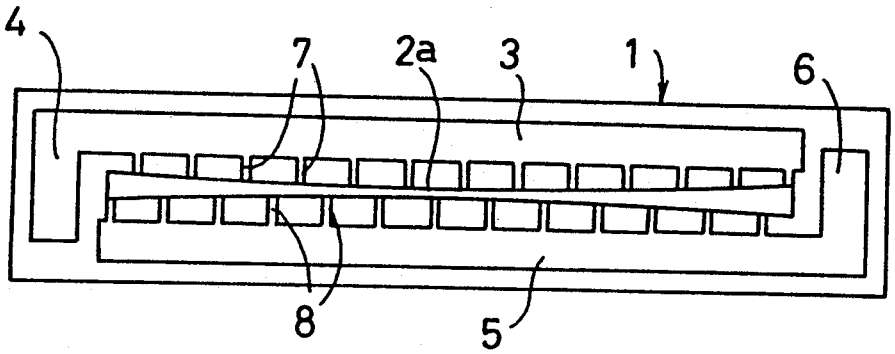
FIG. 9 is a plan view showing a heater according to a fifth embodiment of the present invention.

FIG. 9 represents a heater according to a fifth embodiment of the present invention. The heater of this embodiment is similar to that of the first embodiment (FIGS. 1-3) but differs therefrom in that use is made of a heating resistor line 2*a* whose width is smallest at the center thereof and increases progressively toward the opposite ends of the resistor line.

According to the fifth embodiment of FIG. 9, all of the heating dots provided by the division of the resistor line 2*a* are equal in length, but the width of the heating dots progressively increases toward the opposite ends of the resistor line. Since the current is proportional to the dot width (inversely proportional to the dot resistivity), those of the heating dots located closer to the opposite ends of the resistor line 2*a* generate more heat than the other heating dots, thereby compensating for higher heat dissipation at the respective connection terminals 4, 6. As a result, the temperature distribution is equalized longitudinally of the heating resistor line.

Figure 10:
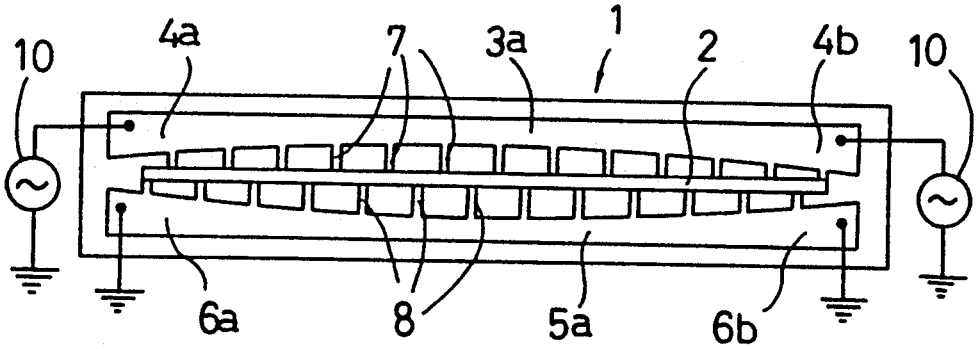
FIG. 10 is a plan view showing a heater according to a sixth embodiment of the present invention.

FIG. 10 illustrates a heater according to a sixth embodiment of the present invention. The heater of this embodiment includes a resistor line 2 which has a constant width along the entire length thereof.

On the other hand, the heater of the sixth embodiment comprises first and second conductor strips 3*a*, 5*a* whose width varies longitudinally thereof. Specifically, the width of the first conductor strip 3*a* is smallest at its center and increases progressively toward its opposite ends 4*a*, 4*b* which work as connection terminals connected to one polarity side of the AC power source 10. Similarly, the width of the second conductor strip 5*a* is smallest at its center and increases progressively toward its opposite ends 6*a*, 6*b* connected to the other polarity side (grounded side) of the power source 10.

According to the sixth embodiment of FIG. 10, the respective connection terminals 4*a*, 4*b* of the first conductor strip 3*a* are held at the same voltage level because of connection to the same side of the power source 10, and the respective connection terminals 6*a*, 6*b* are also held at the same voltage. On the other hand, the inherent resistivity of the conductor strips 3*a*, 5*a* is inversely proportional to the width. Thus, the voltage drop resulting from the respective conductor strips 3*a*, 5*a* is smallest at the opposite ends of the resistor line 2 and largest at the center thereof. As a result, the resistor line 2 generates more heat near its opposite ends than at its center, thereby equalizing the temperature distribution along the entire length of the resistor line.

Obviously, the sixth embodiment shown in FIG. 10 may be modified so that only one of the respective strips 3*a*, 5*a* is made to vary in width along the length thereof.

Figure 11:
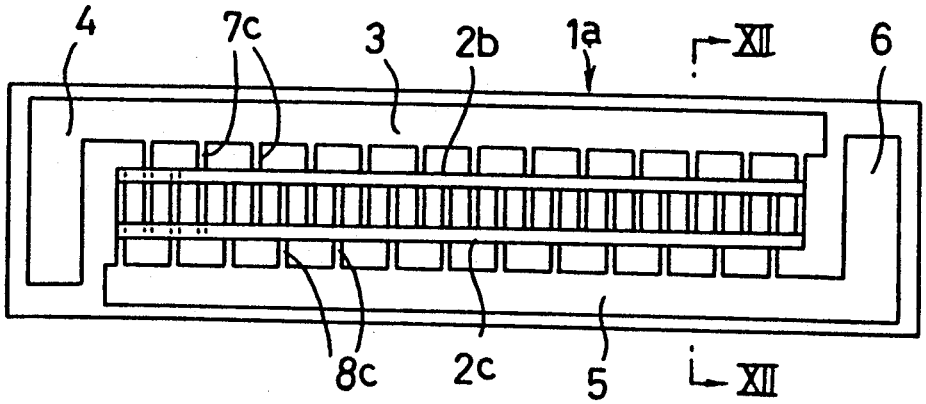
FIG. 11 is a plan view showing a heater according to a seventh embodiment of the present invention.

FIG. 11 shows a heater according to a seventh embodiment of the present invention. The heater of this embodiment includes an insulating substrate la which is rendered wider than those of the foregoing embodiments. The upper surface of the substrate la carries a first conductor strip 3 having a connection terminal 4, and a second conductor strip 5 also having a connection terminal 6, but the transverse spacing between the respective conductor strips 4, 6 is larger than in the foregoing embodiments.

Between the respective conductor strips 3, 5 are arranged a first resistor line 2*b* and a second resistor line 2*c*. The first conductor strip 3 has long electrode teeth 7*c* connected to both of the first and second resistor lines 2*b*, 2*c*. Similarly, the second conductor strip 5 also has long electrode teeth 8*c* connected to both of the first and second resistor lines 2*b*, 2*c* in staggered relation to the electrode teeth 7*c* of the first conductor strip.

Figure 12:
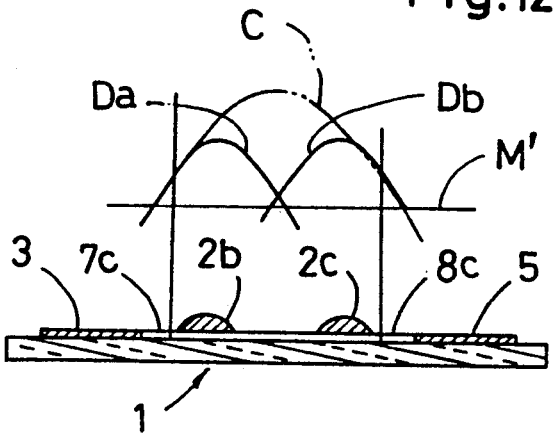
FIG. 12 is a sectional view taken along lines XII—XII in FIG. 11.

To conveniently explain the advantage obtainable by the seventh embodiment of FIG. 11, it is now assumed that a single wide resistor line (or strip) is formed between the respective conductor strips 3, 5. Obviously, the use of such a wide resistor line increases the effective heating width of the heater. However, the respective conductor strips 3, 5 provide portions where heat dissipation is accelerated. Thus, a transverse temperature distribution will result wherein the temperature is sharply higher at the transverse center than at positions near the respective conductor strips, as indicated by a chain line C in FIG. 12. It is therefore necessary to keep the transversely central temperature unnecessarily higher than a minimum required temperature M' (horizontal line).

In the seventh embodiment of FIG. 11, heat generation is provided separately by the first and second resistor lines 2b, 2c which are spaced transversely between the respective conductor strips 3, 5. Thus, the transverse temperature distribution can be more equalized and brought closer to the minimum required temperature M', as indicated by solid lines Da, Db in FIG. 12.

Figure 13:
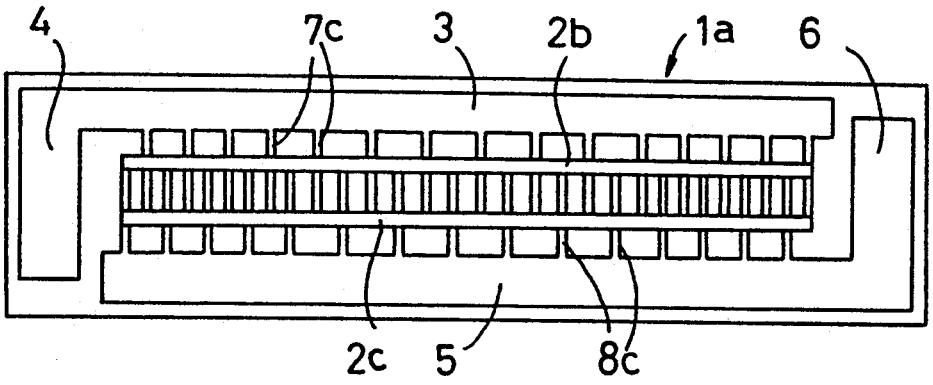
FIG. 13 is a plan view showing a heater according to a eighth embodiment of the present invention.

FIG. 13 illustrates a heater according to an eighth embodiment of the present invention. The heater of this embodiment differs from that of the seventh embodiment (FIG. 11) only in that those of the electrode teeth 7c, 8c located adjacent to the opposite ends of each resistor line 2b, 2c are arranged at a smaller pitch than the other electrode teeth in the central portion of the resistor line, thereby additionally equalizing the longitudinal temperature distribution (similarly to the embodiment of FIG. 7).

Figure 14:
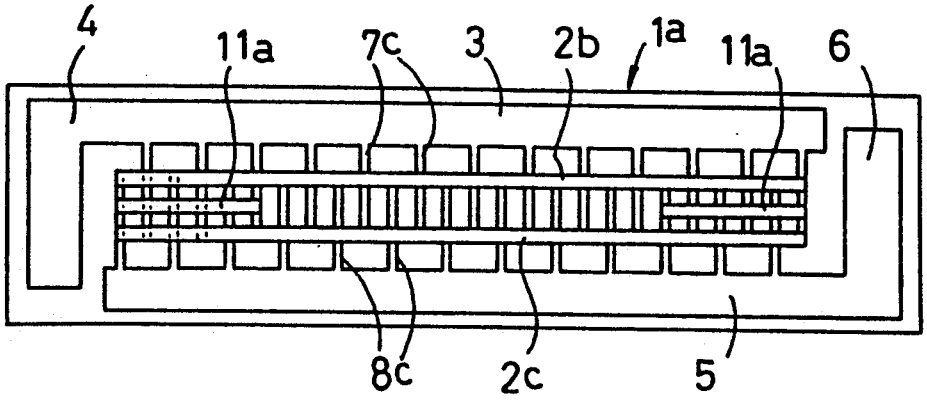
FIG. 14 is a plan view showing a heater according to a ninth embodiment of the present invention.
Figure 15:
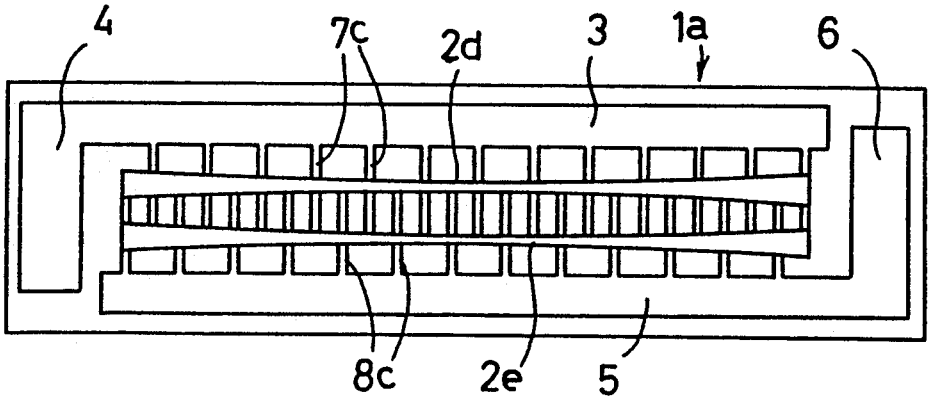
FIG. 15 is a plan view showing a heater according to a tenth embodiment of the present invention.

FIG. 14 shows a heater according to a ninth embodiment of the present invention. The heater of this embodiment is similar to the seventh embodiment of FIG. 11 but differs therefrom only in that auxiliary resistor lines 11a are provided at positions adjacent to the opposite ends of each main resistor line 2b, 2c, thereby additionally equalizing the longitudinal temperature distribution (similarly to the embodiment of FIG. 8).

According to a tenth embodiment of the present invention, use is made of two resistor lines 2d, 2e each of which is narrowest at its longitudinal center and becomes progressively wider toward the opposite ends. Obviously, such an arrangement makes it possible to equalize the longitudinal and transverse temperature distribution of the heater (similarly to the embodiment of FIG. 9).

Figure 16:
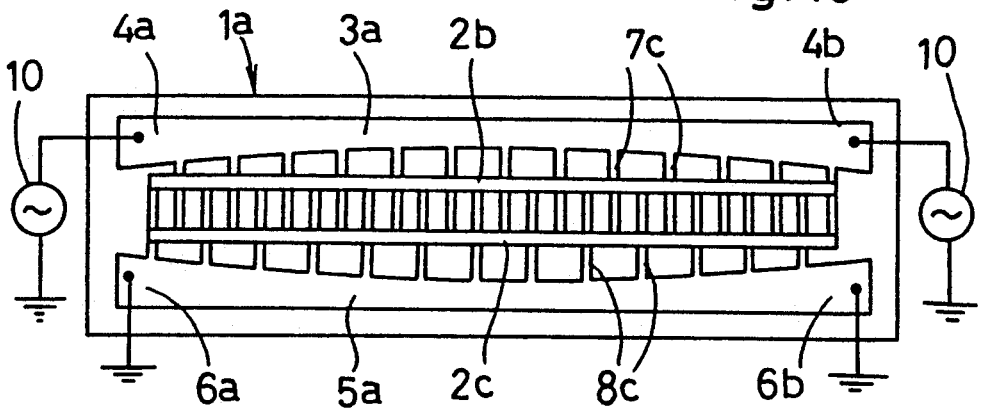
FIG. 16 is a plan view showing a heater according to a eleventh embodiment of the present invention.

An eleventh embodiment shown in FIG. 16 is similar to the embodiment of FIG. 10 except that the former incorporates two resistor lines 2b, 2c between the respective conductor strips 3a, 5a. Again, in this embodiment, the temperature distribution of the heater is equalized both longitudinally and transversely.

Figure 17:
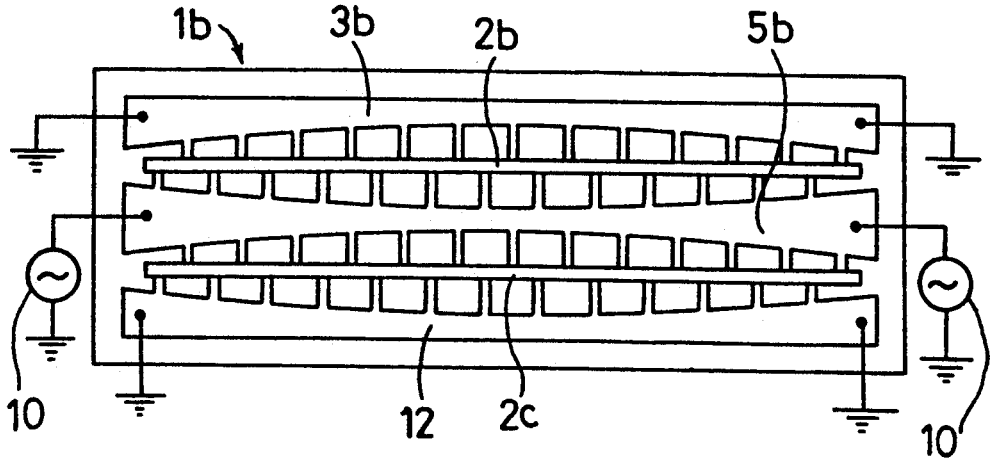
FIG. 17 is a plan view showing a heater according to a twelfth embodiment of the present invention.

FIG. 17 shows a heater according to a twelfth embodiment of the present invention. In this embodiment, use is made of a additionally wider substrate lb for carrying first to third conductor strips 3b, 5b, 12 substantially in parallel to one another. The width of each conductor strip is smallest at its center and progressively increases toward the opposite ends. Further, a first resistor line 2b is arranged between the first and second conductor strips 3b, 5b in conduction therewith, whereas a second resistor line 2c is arranged between the second and third conductor strips 5b, 12 in conduction therewith. This embodiment is otherwise similar to the embodiment of FIG. 10 and provides temperature distribution equalization both in longitudinal and transverse directions.

Figure 18:
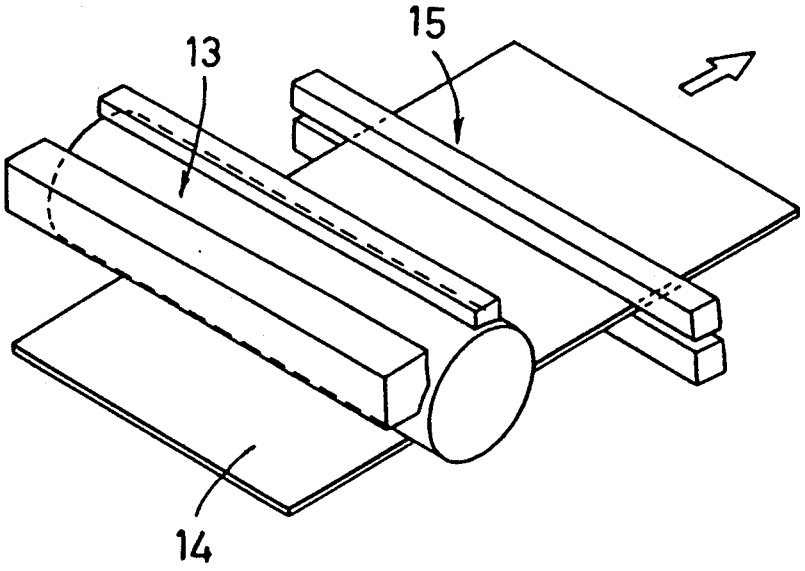
FIG. 18 is a plan view showing a principal portion of a photocopier which incorporates a heater of the present invention.

Either heater of the foregoing embodiments may be used as an image fixing heater for a photocopier, as shown in FIG. 18. Specifically, the photocopier comprises a transfer roll 13 which is held in contact with paper 14 for printing information thereto. The printed information or image is fixed at an image fixing unit 15 by heating the toner deposited on the paper 14.

Obviously, the heater of the present invention may be used as an image fixing heater for an electrographic printer as well. Further, it may be also used for purposes other than image fixation.

The present invention being thus described, it is obvious that the same may be varied in many ways. For instance, selected ones of the embodiments described above may be suitably combined to equalize the temperature distribution longitudinally and/or transversely of the heater. Such variations are not to be regarded as a departure from the spirit and scope of the the invention, and all such modifications as would be obvious to those skilled in the art are intended to be included within the scope of the following claims.

We claim:

1. A heater comprising an insulating substrate which carries a first conductor strip and a second conductor strip spaced transversely from the first conductor strip, the substrate further carrying at least one main resistor line extending between the first and second conductor strips for heating a sheet material, the first conductor strip having a plurality of electrode teeth spaced longitudinally of the main resistor line, the first conductor strip being always held in electric conduction with the main resistor line through all of the electrode teeth of the first conductor strip, the second conductor strip also having a plurality of electrode teeth spaced longitudinally of the main resistor line, the second conductor strip being always held in electric conduction with the main resistor line through all of the electrode teeth of the second conductor strip, wherein substantially the entire length of the main resistor line is simultaneously heated, wherein the electrode teeth of the second conductor strip are arranged in staggered relation to the electrode teeth of the first conductor strip, wherein those of the electrode teeth of the first and second conductor strips located adjacent to both ends of the resistor line are arranged at smaller pitch than the other electrode teeth.

2. The heater according to claim 1, wherein the main resistor line is formed directly on the substrate.

3. A heating unit for an apparatus requiring a heating operation relative to a sheet material, the heating unit comprising an insulating substrate which carries a first conductor strip and a second conductor strip spaced transversely from the first conductor strip, the substrate further carrying at least one main resistor line extending between the first and second conductor strips for heating a sheet material, the first conductor strip having a plurality of electrode teeth spaced longitudinally of the main resistor line, the first conductor strip being always held in electric conduction with the main resistor line through all of the electrode teeth of the first conductor strip, the second conductor strip also having a plurality of electrode teeth spaced longitudinally of the main resistor line, the second conductor strip being always held in electric conduction with the main resistor line through all of the electrode teeth of the second conductor strip, wherein substantially the entire length of the main resistor line is simultaneously heated, wherein the electrode teeth of the second conductor strip are arranged in staggered relation to the electrode teeth of the first conductor strip, wherein those of the electrode teeth of the first and second conductor strips located adjacent to both ends of the resistor line are arranged at smaller pitch that the other electrode teeth.

4. The heating unit according to claim 3, wherein the main resistor line is formed directly on the substrate.

* * * * *